US010814385B2

(12) United States Patent
Hattanda et al.

(10) Patent No.: US 10,814,385 B2
(45) Date of Patent: Oct. 27, 2020

(54) IMMERSION-NOZZLE REPLACEMENT APPARATUS

(71) Applicant: TYK CORPORATION, Minato-ku (JP)

(72) Inventors: Hirokatsu Hattanda, Tajimi (JP); Noriaki Yamauchi, Ena (JP)

(73) Assignee: TYK CORPORATION, Minato-ku (JP)

( * ) Notice: Subject to any disclaimer, the term of this patent is extended or adjusted under 35 U.S.C. 154(b) by 164 days.

(21) Appl. No.: 16/073,995

(22) PCT Filed: Jan. 24, 2017

(86) PCT No.: PCT/JP2017/002229
§ 371 (c)(1),
(2) Date: Jul. 30, 2018

(87) PCT Pub. No.: WO2017/135096
PCT Pub. Date: Aug. 10, 2017

(65) Prior Publication Data

US 2019/0039130 A1 Feb. 7, 2019

(30) Foreign Application Priority Data

Feb. 1, 2016 (JP) ..... 2016-017148

(51) Int. Cl.
*B22D 41/56* (2006.01)
*B22D 11/10* (2006.01)

(52) U.S. Cl.
CPC ..... *B22D 41/56* (2013.01); *B22D 11/10* (2013.01)

(58) Field of Classification Search
CPC ..... B22D 11/10; B22D 41/56; B22D 41/502; B22D 41/24
(Continued)

(56) References Cited

U.S. PATENT DOCUMENTS 5,351,865 A 10/1994 Szadkowski et al.
6,213,357 B1 4/2001 Collura
(Continued)

FOREIGN PATENT DOCUMENTS

CN 2576379 Y 10/2003
CN 1706574 A 12/2005
(Continued)

OTHER PUBLICATIONS

International Search Report dated Feb. 28, 2017 in PCT/JP2017/002229 filed Jan. 24, 2017.
(Continued)

*Primary Examiner* — Scott R Kastler
*Assistant Examiner* — Michael Aboagye
(74) *Attorney, Agent, or Firm* — Oblon, McClelland, Maier & Neustadt, L.L.P.

(57) ABSTRACT

An immersion-nozzle replacement apparatus includes a guide, and a pressing keyboard row. The guide supports two immersion nozzles, a foremost immersion nozzle and a rear immersion nozzle. The guide includes two rows supporting the immersion nozzles via the lower face in the flange. The pressing keyboard row, which is provided in the rows of the guide, includes first keyboards pressing the foremost immersion nozzle via the lower face in the flange. The immersion-nozzle replacement apparatus pushes out the foremost immersion nozzle horizontally with the rear immersion nozzle, and puts the rear immersion nozzle on the pressing keyboard rows. The guide further includes an additionally-pressing keyboard row following a rear end of the pressing keyboard rows, and including a second keyboard pressing the rear immersion nozzle via the lower face in the flange before pushing out the foremost immersion nozzle.

4 Claims, 6 Drawing Sheets

(58) Field of Classification Search
USPC ..... 266/236, 287; 222/591, 600, 606, 607
See application file for complete search history.

(56) References Cited

U.S. PATENT DOCUMENTS

| | | | | |
|---|---|---|---|---|
| 6,902,121 | B2 | 6/2005 | Kawano et al. | |
| 7,108,046 | B2 * | 9/2006 | Kawano ..... | B22D 41/50 164/437 |
| 10,029,303 | B2 | 7/2018 | Yamamoto et al. | |
| 2003/0029892 | A1 | 2/2003 | Kawano et al. | |
| 2006/0137849 | A1 | 6/2006 | Kawano et al. | |
| 2010/0242245 | A1 | 9/2010 | Yamamoto et al. | |
| 2017/0014898 | A1 | 1/2017 | Yamamoto et al. | |

FOREIGN PATENT DOCUMENTS

| | | | |
|---|---|---|---|
| EP | 0 966 334 | B1 | 12/1999 |
| JP | 3009112 | U | 1/1995 |
| JP | 2991495 | B2 | 10/1999 |
| JP | 2002-346705 | A | 12/2002 |
| KR | 10-2012-0108214 | A | 10/2012 |
| WO | WO 92/00822 | A1 | 1/1992 |
| WO | WO 02/094476 | A1 | 11/2002 |
| WO | WO 2009/090891 | A1 | 7/2009 |
| WO | WO 20131153675 | A1 | 10/2013 |
| WO | WO 2015/136736 | A1 | 9/2015 |

OTHER PUBLICATIONS

Written Opinion of International Searching Authority dated Feb. 28, 2017 in PCT/JP2017/002229, 6 pages (with English excerpt translation).

Notification of Reasons for Refusal issued May 15, 2018 in corresponding Japanese Patent Application No. 2016-017148, 6 pages (with English machine translation).

Information Statement dated Jan. 24, 2018 in corresponding Japanese Patent Application No. 2016-017148, 4 pages (with English excerpt machine translation).

Extended European Search Report dated Feb. 13, 2019 in European Patent Application No. 17747255.2, 6 pages.

Combined Chinese Office Action and Search Report dated Nov. 29, 2019 in Chinese Patent Application No. 201780009253.7 (with unedited computer generated English translation and English translation of Category of Cited Documents), 14 pages.

* cited by examiner

IMMERSION-NOZZLE REPLACEMENT APPARATUS

TECHNICAL FIELD

The present invention relates to an immersion-nozzle replacement apparatus used for the continuous founding of molten metal. The immersion-nozzle replacement apparatus presses an immersion nozzle to retain it under a flow-out port for molten metal which is formed in the bottom of a molten-metal retainer, and further replaces a worn down or damaged immersion nozzle with the new one.

BACKGROUND ART

In the continuous founding of molten metal, a molten metal has been flowed from out of a flow-out port which is formed in the bottom of a molten-metal retainer, and then pouring and casting of the molten metal have been carried. On this occasion, an immersion-nozzle replacement apparatus has been used to retain a tubular immersion nozzle by adhering it onto the flow-out port, and then to replace it with an unused immersion nozzle.

Using the immersion nozzles allows preventing the oxidation of molten metal, the involvement of nonmetallic intervening substance, and the occurrence of disturbed flow or splash upon the pouring and casting of molten metal. The tubular part of an immersion nozzle is likely to be worn down or damaged, for instance, to be lost by welding, chipped away or broken, because the immersion nozzle is used under such severe conditions that it makes contact with a flowing molten metal on the inner-peripheral face side and touches outside air on the outer-peripheral face side. Moreover, alumina, or the like, in molten metal adheres onto the inner-peripheral face in the immersion nozzle to deposit on it, narrowing down a molten-metal flow passage in the immersion nozzle, and having clogged it up to forcibly necessitate the interruption of founding operations when the alumina deposits on the inner-peripheral face severely. Consequently, it is required to replace the immersion nozzles frequently in the middle of casting when the casting is done continuously for a long period of time. In addition, it has been sought to make the immersion nozzles replaceable quickly in the middle of founding operations in order to prevent deteriorations in metallic quality, which result from the interruption of founding operations, and troubles associated with resuming the founding operations.

Patent Literature No. 1 discloses an immersion-nozzle replacement apparatus for retaining immersion nozzles and replacing them quickly. The immersion-nozzle replacement apparatus uses immersion nozzles, each of which comprises a lower tube and an upper flange with a sprue port, while retaining one of the immersion nozzles under a flow-out port in a molten-metal retainer. Moreover, the immersion-nozzle replacement apparatus arranges one of prior-to-use immersion nozzles so as to horizontally come in contact with a side face in the retained in-service immersion nozzle, and then pushes the prior-to-use immersion nozzle toward the in-service immersion nozzle to substitute the former for the latter. Thus, the immersion-nozzle replacement apparatus replaces the in-service immersion nozzle with the prior-to-use immersion nozzle. The immersion-nozzle replacement apparatus comprises four keyboards for retaining the in-service immersion nozzle. The keyboards, which are disposed beneath a lower face in the flange of the in-service immersion nozzle and are aligned in a row on each of the opposite sides of the tube of the in-service immersion nozzle, press the lower face in the flange of the in-service immersion nozzle onto the flow-out port in the molten-metal retainer held up above. Moreover, the immersion-nozzle replacement apparatus further comprises two rod-shaped guide rails for retaining the prior-to-use immersion nozzle by the flange. The guide rails elongate on the opposite sides of the tube of the prior-to-use immersion nozzle, and have a smooth upper face. Thus, the prior-to-use immersion nozzle moves on the guide rails. The immersion-nozzle replacement apparatus pushes the prior-to-use immersion nozzle on the guide rails to move it toward the in-service immersion nozzle. When the immersion-nozzle replacement apparatus moves the prior-to-use immersion nozzle to the underside of the flow-out port in the molten-metal retainer, the flange of the prior-to-use immersion nozzle slides on the guide rails while being pressed onto the flow-out port by the keyboards. Hence, even during founding operations, the immersion-nozzle replacement apparatus allows replacing the in-service immersion nozzle with the prior-to-use immersion nozzle without any leakage of molten metal.

RELATED TECHNICAL LITERATURE

Patent Literature

Patent Literature No. 1: Japanese Utility Model Registration Gazette No. 3009112

SUMMARY OF THE INVENTION

Assignment to be Solved by the Invention

In the immersion-nozzle replacement apparatus according to Patent Literature No. 1, the in-service immersion nozzle, which is pushed upward by the keyboards, is located at a higher position than another position where the prior-to-use immersion nozzle is located on the guide rails. The upper face in the keyboards is present at a higher position than that of the guide rails, resulting in unevenness or a bump between the upper face in the keyboards and that in the guide rails. The prior-to-use immersion nozzle, which is caught on the bump between the keyboards and the guide rails (namely, on the side face in one of the keyboards), stops moving even if it is pushed out to move toward the in-service immersion nozzle, preventing the smooth replacement of the in-service immersion nozzle with the prior-to-use immersion nozzle. As a result, the immersion-nozzle replacement apparatus might adversely not have replaced the immersion nozzles quickly.

The present invention has been made in view of the above-mentioned circumstances. Hence, it is an assignment to the present invention to provide an immersion-nozzle replacement apparatus allowing a quick and steady replacement of immersion nozzles without any leakage of molten metal even during founding operations.

Means for Solving the Assignment

In order to achieve the aforementioned object, an immersion-nozzle replacement apparatus according to the present invention comprises:

a guiding means supporting at least two immersion nozzles, a foremost immersion nozzle and a rear immersion nozzle following the foremost immersion nozzle, the two immersion nozzles having an upper flange with a sprue port, and a lower tube, the guiding means including two rows each of which is disposed parallel to one another on both sides of the tube of each of the immersion nozzles to support a lower face in the flange of each of the immersion nozzles while coming into contact with a side face in the flange of each of the immersion nozzles horizontally; and a pressing keyboard row provided in each of the rows of the guiding means, and including a plurality of first keyboards pressing the lower face in the flange of the foremost immersion nozzle onto a flow-out port in a molten-metal retainer;

the immersion-nozzle replacement apparatus pushes out the foremost immersion nozzle horizontally with the rear immersion nozzle, as well as putting the rear immersion nozzle on each of the pressing keyboard rows; and the guiding means further includes an additionally-pressing keyboard row which follows a rear end of each of the pressing keyboard rows and includes at least one second keyboard pressing the lower face in the flange of the rear immersion nozzle before pushing out the foremost immersion nozzle.

The pressing keyboard rows, which are present beneath the lower face in the flange of the foremost immersion nozzle, push the flange upward, adhering the flange onto the flow-out port in the molten-metal retainer. Meanwhile, the flange of the rear immersion nozzle is located to neighbor the rear end of the flange of the foremost immersion nozzle. In the same manner as the pressing keyboard rows push the flange of the foremost immersion nozzle upward via the lower face, the additionally-pressing keyboard rows push the flange of the rear immersion nozzle upward at the leading end via the lower face. Consequently, the immersion-nozzle replacement apparatus according to the present invention allows the rear immersion nozzle, which has been pushed out to move on the pressing keyboard rows, to move smoothly on the pressing keyboard rows without being caught on the side face in the rearmost first keyboards in the pressing keyboard rows. That is, the present immersion-nozzle replacement apparatus permits replacing the foremost immersion nozzle with the rear immersion nozzle quickly and steadily without any leakage of molten metal even during founding operations.

Moreover, the immersion-nozzle according to the present invention preferably further comprises the second keyboard including an upper face pressing the lower face in the flange, part of the upper face making an inclined face which heightens toward a leading-end side thereof. At a predetermined position, the additionally-pressing keyboard rows press the leading-end part of the lower face in the flange of the rear immersion nozzle upward, locating the leading-end part of the flange at a higher position than that of the rear-end part. Therefore, in the moving rear immersion nozzle, the leading end of the flange of the rear immersion nozzle needs to move in the height direction as well so as to place the leading end of the flange of the rear immersion nozzle from a rear position trailing the additionally-pressing keyboard rows to a position on the additionally-pressing keyboard rows making the predetermined portion. The second keyboard with the upper face including the inclined face, which is lower on the rear-end side and is higher on the leading-end side, puts the leading-end part of the lower face in the flange of the rear immersion nozzle, which is moving to the predetermined position, on the inclined face in the second keyboard, and then moves the flange of the rear immersion nozzle upward along the inclined face, ensuring the flange to move smoothly in the height direction. Consequently, the second keyboard allows replacing the foremost immersion nozzle with the rear immersion nozzle more quickly and reliably.

In addition, the immersion-nozzle replacement apparatus according to the present invention more preferably further comprises the second keyboard including a leading-end side in part of the upper face pressing the lower face in the flange, the leading-end side pressing the lower face in the flange of the foremost immersion nozzle at a rear end thereof. The upper face in the second keyboard, which also comes in contact with the flange of the foremost immersion nozzle, makes its own height equal to that of the upper face in the first keyboards reliably. Therefore, the second keyboard allows better inhibiting the rear immersion nozzle, which is pushed out to move forward, from being caught on the side face in the rearmost first keyboards, permitting the rear immersion nozzle to move more reliably. Consequently, the thus modified present immersion-nozzle replacement apparatus allows replacing the foremost immersion nozzle with the rear immersion nozzle quickly and steadily without any leakage of molten metal even during founding operations.

Effect of the Invention

The immersion-nozzle replacement apparatus according to the present invention comprises the pressing keyboard rows pressing the lower face in the flange of the foremost immersion nozzle upward, adhering the upper face in the flange of the foremost immersion nozzle onto a flow-out port in the molten-metal retainer. Meanwhile, the flange of the rear immersion nozzle is located to neighbor the rear end of the flange of the foremost immersion nozzle. In the same manner as the pressing keyboard rows push the lower face in the flange of the foremost immersion nozzle upward, the additionally-pressing keyboard rows press the lower face in the flange of the rear immersion nozzle upward. Thus, the present immersion-nozzle replacement apparatus allows the rear immersion nozzle, which is pushed out to move on the pressing keyboard rows, to move smoothly on the pressing keyboard rows without being caught on the side face in the rearmost keyboards of the pressing keyboard rows. That is, the present immersion-nozzle replacement apparatus permits replacing the foremost immersion nozzle with the rear immersion nozzle quickly and steadily without any leakage of molten metal even during founding operations.

MODE FOR CARRYING OUT THE INVENTION

First Embodiment

Figure 1:
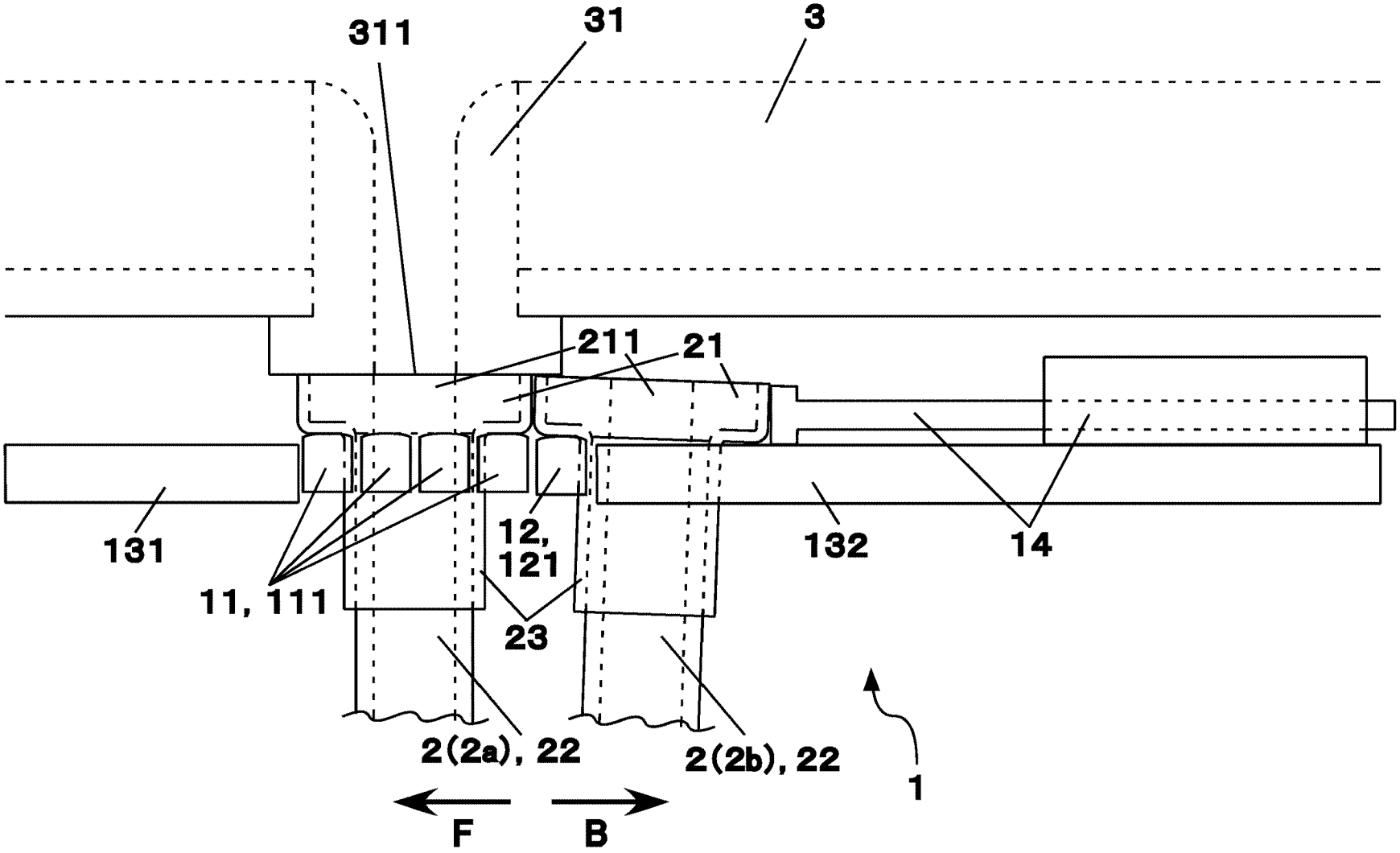
FIG. 1 is a side view of an immersion-nozzle replacement apparatus directed to First Embodiment of the present invention.

A molten-metal retainer 3, which accommodates a molten metal in it, is provided with a flow-out port 31 in the bottom.

A tubular immersion nozzle 2 is retained under the flow-out port 31. The molten metal, which has flowed out through the flow-out port 31 of the molten-metal retainer 3, flows on the inner-peripheral face side in a tube 22 of the immersion nozzle 2 retained under the flow-out port 31. An in-service immersion nozzle 2*a*, which has worn down or damaged, is replaced with a prior-to-use immersion nozzle 2*b*. An immersion-nozzle replacement apparatus 1 according to First Embodiment has functions of retaining the in-service immersion nozzle 2*a* under the flow-out port 31 in the bottom of the molten-metal retainer 3, and replacing the in-service immersion nozzle 2*a*, which has worn down or damaged, with the prior-to-use immersion nozzle 2*b*.

The flow-out port 31, which is provided in the bottom of the molten-metal retainer 3, has an opening 311 through which the molten metal flows out. The flow-out port 31 has satisfactorily at least one opening 311, not limited to that shown in the drawings.

The immersion nozzle 2 comprises a flange 21 with a sprue port 211 on the top, and a lower tube 22. Moreover, the immersion nozzle 2 is provided with an iron cladding 23, which covers the side and lower faces in the flange 21 as well as the upside of the tube 22. The flange 21 according to First Embodiment has a square configuration whose corners are rounded. Not limited to the square configuration whose corners are rounded, the flange 21 satisfactorily has a configuration with two sides which oppose parallel to one another. For example, the flange 21 competently has an octagonal configuration, or adequately has a rectangular configuration whose corners are rounded. The immersion nozzle 2 is used while being pushed onto the flow-out port 31 in the bottom of the molten-metal retainer 3. The prior-to-use immersion nozzle 2*b* is arranged at a position where it comes in contact with one of the opposite side faces in the flange 21 of the in-service immersion nozzle 2*a*. The prior-to-use immersion nozzle 2*b*, which is pushed out toward the in-service immersion nozzle 2*a* (i.e., in the forward direction designated with the arrow "F"), substitutes for the in-service (i.e., foremost) immersion nozzle 2*a*. Note herein that the direction, which is opposite to the forward direction designated with the arrow "F," is labeled the backward direction designated with the arrow "B."

Figure 2:
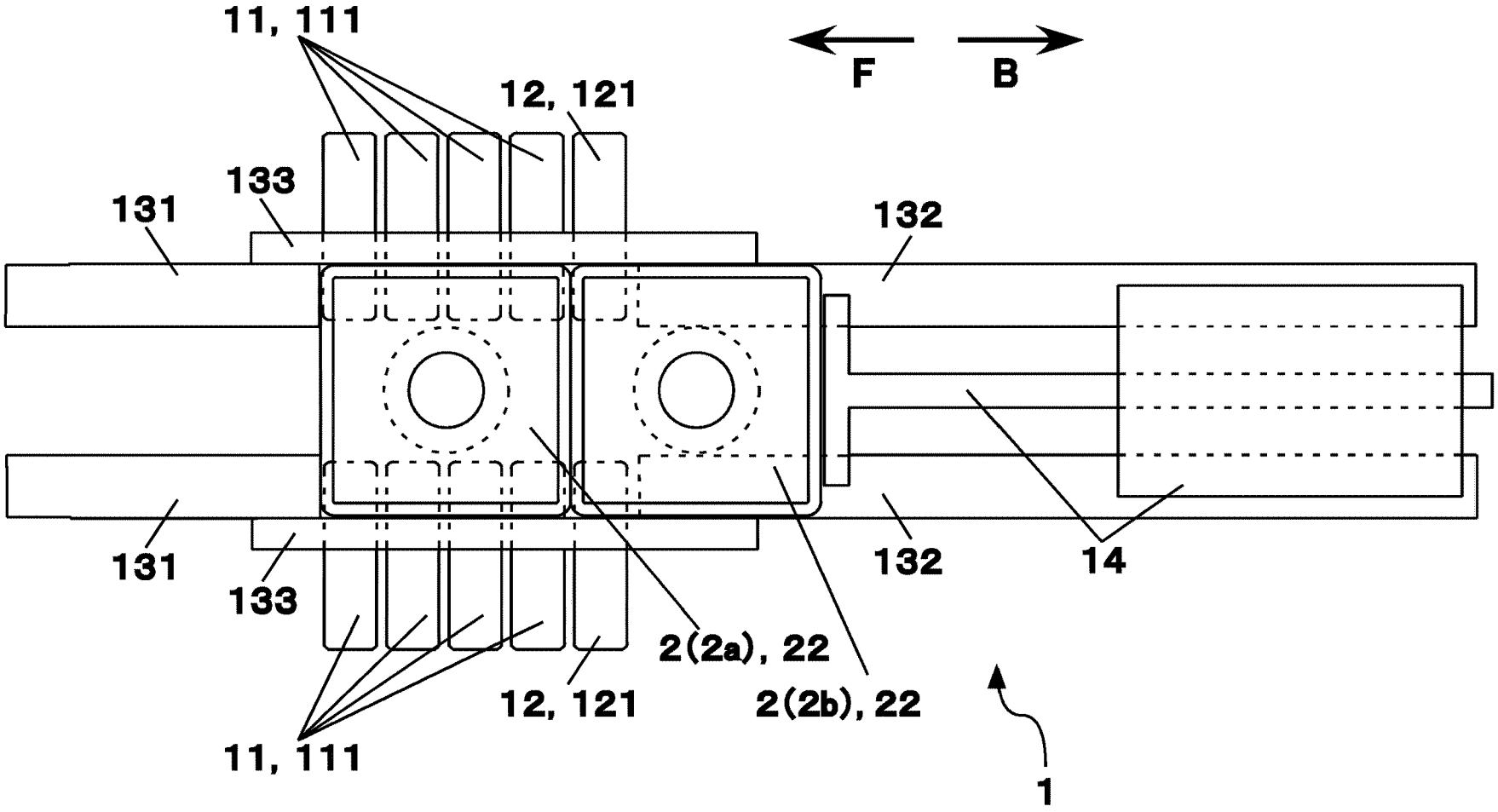
FIG. 2 is a top view of the immersion-nozzle replacement apparatus directed to First Embodiment.

The immersion-nozzle replacement apparatus 1 comprises a guiding means, and a push-out means 14. The guiding means includes keyboard rows 11, additionally-pressing keyboard rows 12, forward lower-face retaining members 131, backward lower-face retaining members 132, and side-face retaining members 133. Each of the keyboard rows 11 is made up of first keyboards 111 pressing the in-service immersion nozzle 2*a* onto the flow-out port 31 in the bottom of the molten-metal retainer 3. Each of the additionally-pressing keyboard rows 12 is made up of a second keyboard 121 adjusting the prior-to-use immersion nozzle 2*b* in terms of the position. Each of the forward lower-face retaining members 131 supports the in-service immersion nozzle 2*a* to be replaced. Each of the backward retaining members 132 supports the prior-to-use immersion nozzle 2*b*. The side-face retaining members 133 support the opposite side faces of the in-service immersion nozzle 2*a* and prior-to-use immersion nozzle 2*b*, as shown in FIG. 2. The push-out means 14 pushes out the prior-to-use immersion nozzle 2*b* forward.

Each of the keyboard rows 11 includes four first keyboards 111 disposed in a row beneath the flow-out port 21 in the bottom of the molten-metal retainer 3 to push the flange 21 of the in-service immersion nozzle 2*a* upward. The keyboard rows 11 are provided in a quantity of two that are arranged parallel to one another and are kept apart at a distance across from one another. The two keyboard rows 11, between which the tube 22 of the in-service immersion nozzle 21 is interposed, are disposed under the flange 21 of the in-service immersion nozzle 2*a*.

Figure 3:
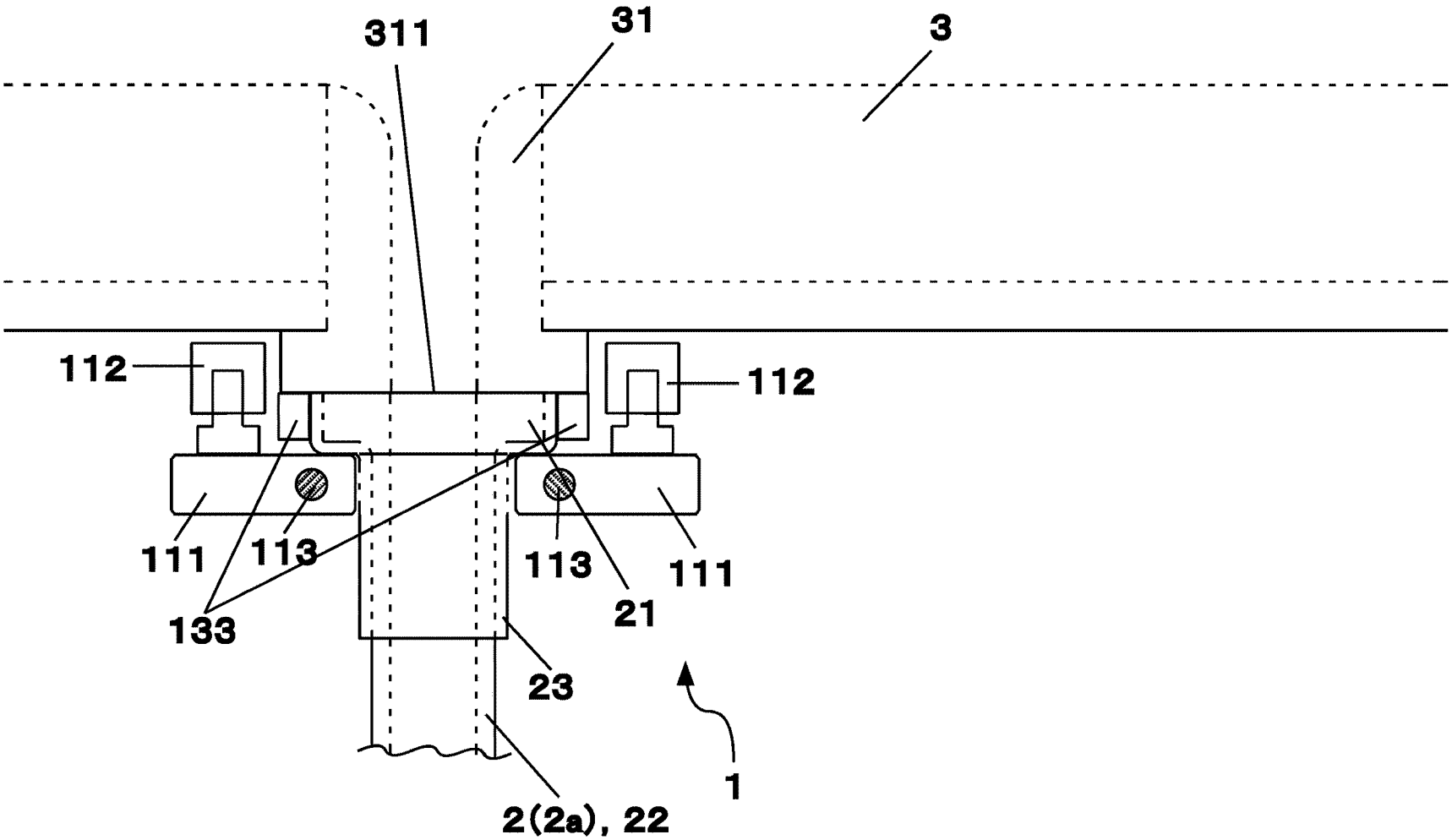
FIG. 3 is a front view of the immersion-nozzle replacement apparatus directed to First Embodiment.
Figure 4:
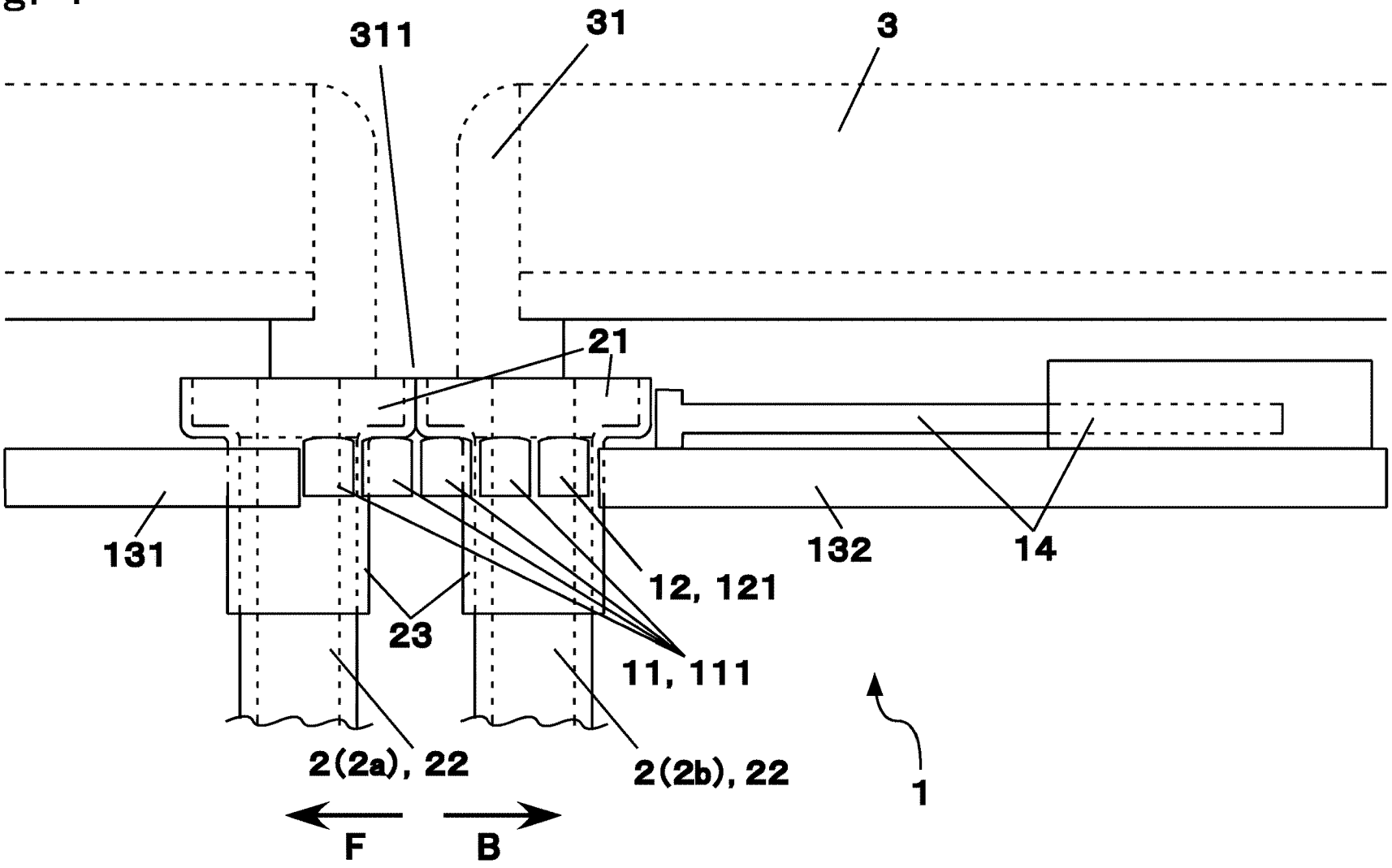
FIG. 4 is a side view of the immersion-nozzle replacement apparatus directed to First Embodiment that is put in the process of replacing immersion nozzles.

The first keyboard rows 11 are made to include the first keyboards 111 in a quantity of four, respectively. Each of the first keyboard rows 11 satisfactorily includes one or more first keyboards 111; or competently includes two or three first keyboards 111; or adequately includes even only one first keyboard 111, depending on circumstances. FIGS. 1 through 3 it illustrate the first keyboards 111 according to First Embodiment.

As illustrated in FIG. 2, the first keyboards 111 comprise rod-shaped members extending horizontally in a direction away from the tube 22 of the in-service nozzle 2*a*. Not limited to the configuration, the first keyboards 111, however, have any configuration; for example, the first keyboards 111 satisfactorily comprise rod-shaped members swelling like a spoon at around one of the opposite ends on the lower side of the flange 21 of the in-service immersion nozzle 2*a*. Moreover, the first keyboard rows 11 further comprise rotary shafts 113 that penetrate through the respective first keyboards 111 constituting the first keyboard rows 11 so as to impale or pierce them, as well as to support the respective first keyboards 111, as shown in FIG. 3.

As illustrated in FIG. 3, the keyboard rows 11 are provided with keyboard pressing members 112, which press the first keyboards 111 downward from the up above, at locations apart from the rotary shafts 113, when the in-service immersion nozzle 2*a* is viewed from the side of the flange 21. Note that each one of the keyboard pressing members 112 is provided for each one of the first keyboards 111.

So far as the keyboard pressing members 112 are capable of satisfactorily pressing the keyboards 111, they are made competently using hydraulic cylinders, for instance. When the keyboard pressing members 112 press the first keyboards 111 downward from the up above, the first keyboards 111 rotate around the rotary shafts 113 to push the lower face in the flange 21 upward. So far as the rotary shafts 113 satisfactorily support the rotating first keyboards 111, they are not necessarily shafts that penetrate through the respective first keyboards 111 so as to impale or pierce them. For example, the keyboard rows 11 are competently formed so as to have a configuration with downwardly-directed dents that accommodate the rotary shafts 113.

The first keyboards 111, which press the lower face in the flange 21 of the in-service immersion nozzle 2*a* upward, pushes up the flange 21 against the flow-out port 31 in the bottom of the molten-metal retainer 3. Eventually, the first keyboards 111 retain the in-service immersion nozzle 2*a* while pushing it up against the flow-out port 31 in the bottom of the molten-metal retainer 3.

Figure 5:
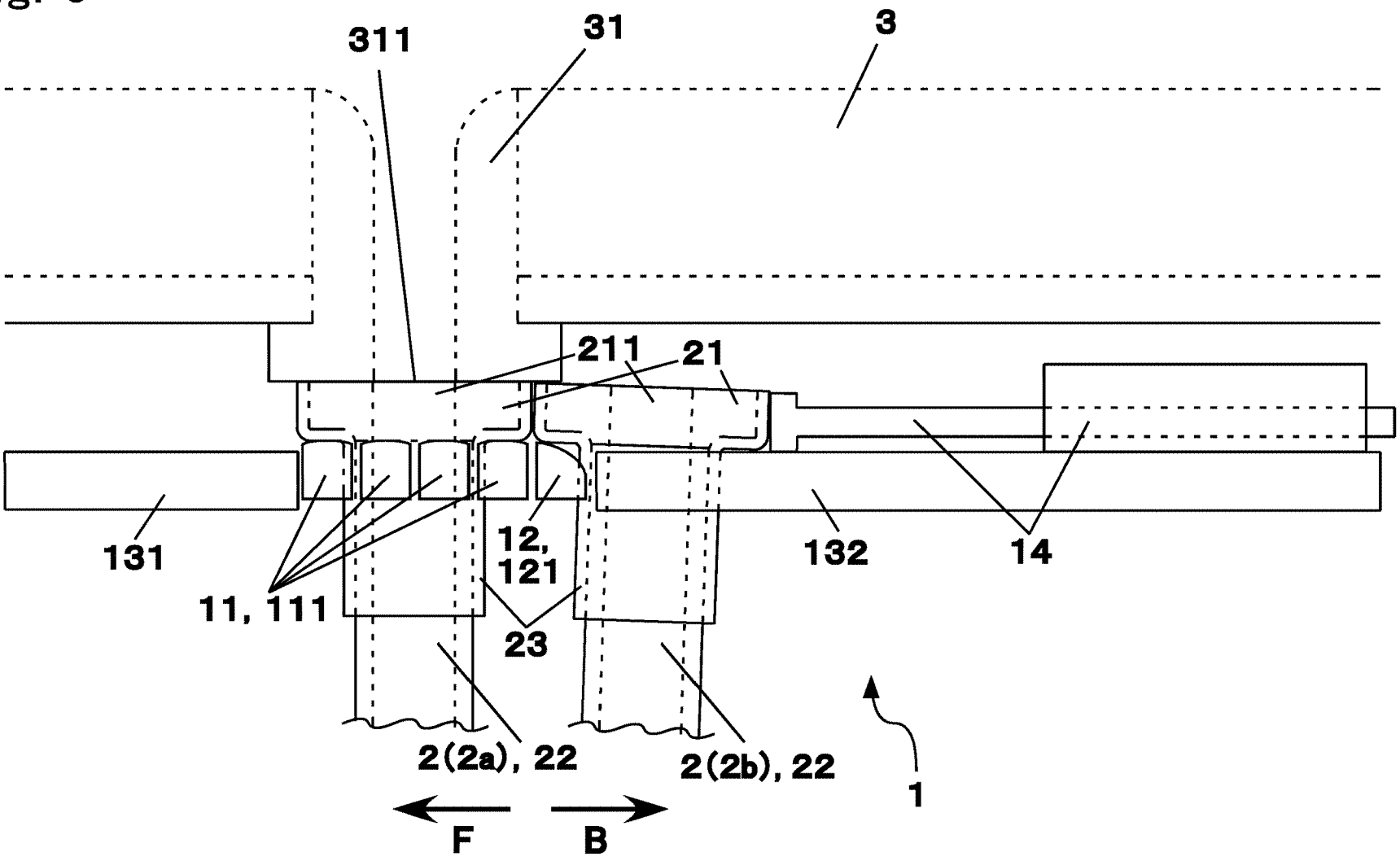
FIG. 5 is a side view of an immersion-nozzle replacement apparatus directed to Second Embodiment of the present invention.
Figure 6:
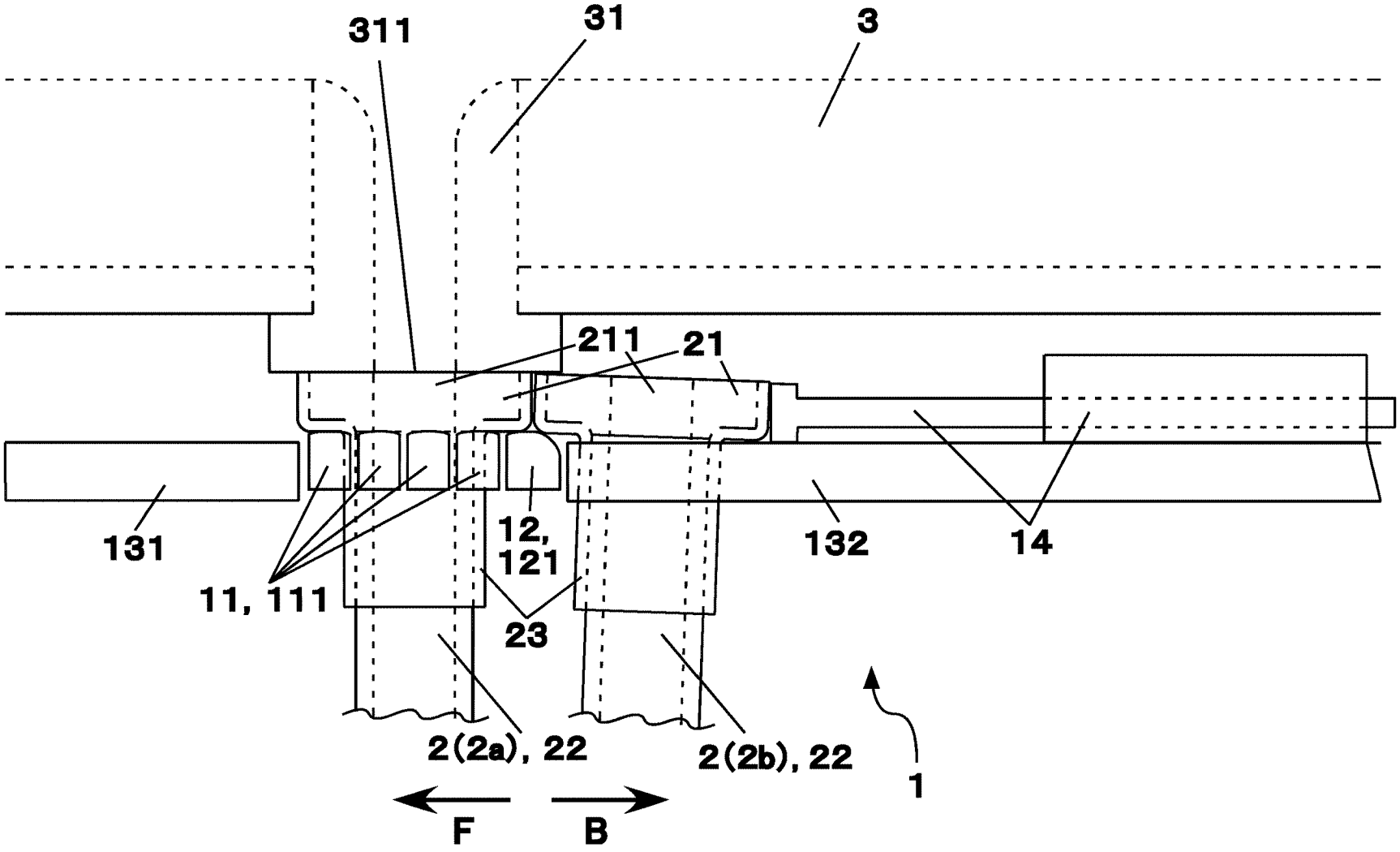
FIG. 6 is a side view of an immersion-nozzle replacement apparatus directed to Third Embodiment of the present invention.

The second keyboards 121 are keyboards that are disposed at the leading end on the backward side "B" so as to come next to one of the first keyboards 111 present nearest to the backward side "B" in the keyboard rows 11. As illustrated in FIGS. 1, 5 and 6, the second keyboards 121 press the prior-to-use immersion nozzle 2*b* upward at the leading end on the forward side "F" to adjust the height of the prior-to-use immersion nozzle 2*b* so as to make it identical with that of the in-service immersion nozzle 2*a* at the trailing end on the forward side "F." Not-shown rotary shafts support the second keyboards 121, and not-shown keyboard pressing members press them, in the same manner as described for the first keyboards 111. The rotary shafts supporting the second keyboards 121 are satisfactorily shafts that extend from the rotary shafts 113 supporting the first keyboards 113, or are competently shafts that are made independently of the rotary shafts 113 for the first keyboards. Note that the keyboard pressing members 112 also adjust the second keyboards 121 so as not to give the upper face a height which surpasses that of the upper face in the first keyboards 111.

Moreover, the immersion-nozzle replacement apparatus 1 according to First Embodiment further comprises three type of the guiding members, two of which make a pair and are disposed to extend toward the forward side "F" or backward side "B" so as to interpose the tube 22 of the in-service and prior-to-use immersion nozzles (2*a*, 2*b*) between them. The three types of the guiding members include the forward lower-face retaining members 131, the backward lower-face retaining members 132, and the side-face retaining members 133. The forward lower-face retaining members 131 retain a used immersion nozzle 2, which is located on the forward side "F" in the keyboard rows 11, from down below via the lower face. The backward lower-face retaining members 132 retain the prior-to-use immersion nozzle 2*b*, which is located on the backward side "B" in the additionally-pressing keyboards 12, from down below via the lower face. The side-face retaining members 133 are disposed so as to interpose the in-service and prior-to-use immersion nozzles (2*a*, 2*b*) between them to positionally adjust the side faces in the in-service and prior-to-use immersion nozzles (2*a*, 2*b*). Depending on circumstances, three types of the guiding members are satisfactorily free of the forward lower-face retaining members 131, so far as the guide members make it possible to suitably handle the used immersion nozzle 2.

The push-out means 14 is located on the backward side "B" relative to the prior-to-use immersion nozzle 2*b*. The push-out means 14 pushes out the prior-to-use immersion nozzle 2*b* toward the in-service immersion nozzle 2*a*, namely, toward the forward side "F," substituting the prior-to-use immersion nozzle 2*b* for the in-service immersion nozzle 2*a*. The push-out means 14 is made satisfactorily using a hydraulic cylinder, for instance, so far as it is a means for competently pushing out the prior-to-use immersion nozzle 2*b*.

How the immersion-nozzle replacement apparatus according to First Embodiment operates will be hereinafter described. First of all, the push-out means 14 pushes the prior-to-use immersion nozzle 2*b* toward the underside of the flow-out port 31 in the molten-metal retainer 3, and moves it to a position of use. Meanwhile, the multiple first keyboards 111 press the in-service immersion nozzle 2*a*, which is located beneath the flow-out port 31, onto the flow-out port 31. Thus, the in-service immersion nozzle 2*a*, which the first keyboards 111 retain, is used while closely adhering to the flow-out port 31. Subsequently, the push-out means locates the prior-to-use immersion nozzle 2*b* on the backward side "B" relative to the in-service immersion nozzle 2*a*. Then, the push-out means 14 moves the prior-to-use immersion nozzle 2*b* to a location where the side face in the flange 21 of the prior-to-use immersion nozzle 2*b* neighbors on the forward side "F" the side face in the flange 21 of the in-service immersion nozzle 2*a* on the backward side "B." On this occasion, the second pressing keyboards 121 press the flange 21 of the prior-to-use immersion nozzle 2*b* at the leading end on the forward side "F" to provide the flange 21 of the prior-to-use immersion nozzle 2*b* with the same height as that of the flange 21 of the in-service immersion nozzle 2*a*. When the in-service immersion nozzle 2*a* has been so worn down or damaged that the replacement is needed, the push-out means 14 pushes out the prior-to-use immersion nozzle 2*b* to the forward side "F," moving it to the location where the in-service immersion nozzle 2*a* is present. Consequently, the prior-to-use immersion nozzle 2*b* substitutes for the in-service immersion nozzle 2*a*. Thus, the immersion-nozzle replacement apparatus 1 according to First Embodiment replaces the in-service immersion nozzle 2*a* with the prior-to-use immersion nozzle 2*b*.

The immersion-nozzle replacement apparatus 1 according to First Embodiment comprises the first keyboards 11 pushing the flange 21 of the in-service (i.e., foremost) immersion nozzle 2*a* onto the flow-out port 31 in the bottom of the molten-metal retainer 31. Thus, the flange 21 of the in-service immersion nozzle 2*a* and the bottom face in the flow-out port 31 adhere to one another. Consequently, the immersion-nozzle replacement apparatus 1 inhibits the suction or leakage of air in the molten metal between the flow-out port 31 and the in-service immersion nozzle 2*a*.

Moreover, as the push-out means 14 pushes out the prior-to-use immersion nozzle 2*b* on the backward side "B" toward the forward side "F" to come nearer the underside of the flow-out port 31, the first keyboards 111 push up the flange 21 of the prior-to-use immersion nozzle 2*b* onto the flow-out port 31. Thus, the flow-out port 31 and the flange 21 of the prior-to-use immersion nozzle 2*b* adhere to one another. Consequently, the immersion-nozzle replacement apparatus 1 according to First Embodiment allows replacing one of the immersion nozzles 2 with the other one of them without any leakage of molten metal even during founding operations, because the in-service immersion nozzle 2*a* and prior-to-use immersion nozzle 2*b* slide on the lower face in the flow-out port 31 of the molten-metal retainer 3 while they are pushed against the lower face when the push-out means 14 pushes out the prior-to-use immersion nozzle 2*b* toward the forward side "F."

The pressing keyboard rows 11, which are present beneath the lower face in the flange 21 of the in-service immersion nozzle 2*a*, push the flange 21 upward so that the flange 21 and the flow-out port 31 of the molten-metal retainer 3 adhere to one another. Meanwhile, the push-out means 14 locates the flange 21 of the prior-to-use immersion nozzle 2*b* so as to neighbor the trailing end of the flange 21 of the in-service immersion nozzle 2*a*. In the same manner as the pressing keyboard rows 11 press the in-service immersion nozzle 2*a* upward from down below via the lower face, the additionally-pressing keyboard rows 12 press the leading end of the flange 21 of the prior-to-use immersion nozzle 2*b* upward from down below via the lower face. Consequently, the additionally-pressing keyboard rows 12 allow the prior-to-use immersion nozzle 2*b*, which the push-out means 14 pushes out to move on the pressing keyboard rows 11, to move smoothly on the pressing keyboard rows 11 without being caught on the side faces in the rearmost first keyboards 111 in the pressing keyboard rows 11. That is, the immersion-nozzle replacement apparatus 1 according to First Embodiment permits replacing one of the immersion nozzles 2 with the other one of them quickly and steadily without any leakage of molten metal even during founding operations.

Second Embodiment

An immersion-nozzle replacement apparatus 1 according to Second Embodiment basically comprises the same constituents as those of First Embodiment, and operates to produce advantageous effects in the same manner as First Embodiment. FIG. 5 illustrates the immersion-nozzle apparatus 1 according to Second Embodiment. As illustrated in the drawing, the second keyboards 121 according to Second Embodiment include an upper face pressing the lower face in the flange 21 of one the prior-to-use immersion nozzle 2*b*. Moreover, part of the upper face makes an inclined face which heightens toward the leading-end side.

At a predetermined position, the additionally-pressing keyboard rows 12 press the flange 21 of the prior-to-use immersion nozzle 2*b* from down below via the lower face so as to locate the leading end at a higher position than that of the trailing end. Therefore, the leading end of the flange 21 of the prior-to-use immersion nozzle 2*b* needs to move in the height direction as well when the prior-to-use immersion nozzle 2*b* is moving so as to locate the leading end of the flange 21 of the prior-to-use immersion nozzle 2*b* from a position, which is located on a more backward side "B" than that of the additionally-pressing keyboard rows 12, to another position that makes the predetermined position on the additionally-pressing keyboard rows 12. The second keyboards 121, whose upper face is made lower on the trailing-end side and whose leading-end side is made higher, move the prior-to-use immersion nozzle 2*b* in the height direction smoothly and reliably when the prior-to-use immersion nozzle 2*b* is moving to the predetermined position. Consequently, the immersion-nozzle replacement apparatus 1 according to Second Embodiment allows replacing one of the immersion nozzles 2 with the other one of them quickly and reliably.

Third Embodiment

An immersion-nozzle replacement apparatus 1 according to Third Embodiment basically comprises the same constituents as those of First and Second Embodiments, and operates to produce advantageous effects in the same manner as First and Second Embodiments. FIG. 6 illustrates the immersion-nozzle apparatus 1 according to Third Embodiment. As illustrated in the drawing, the second keyboards 121 according to Third Embodiment are keyboards pressing the trailing end of the in-service immersion nozzle 2*a* and the leading end of the prior-to-use immersion nozzle 2*b* upward. In the same manner as the second keyboards 121 according to Second Embodiment, the second keyboards 121 according to Third Embodiment include an upper face pressing the lower face in the flange 21 of the prior-to-use immersion nozzle 2*b*. Moreover, part of the upper face makes an inclined face whose leading-end side is made higher and trailing-end side is made lower. The upper face in the second keyboards 121 comes to reliably have a height equal to that the upper face in the first keyboards 111 has, because the upper face in the second keyboards 121 comes in contact with the flange 21 of the in-service immersion nozzle 2*a* as well. Therefore, the second keyboards 121 allow the prior-to-use immersion nozzle 2*b* to move more reliably, because they make it possible to better inhibit the prior-to-use immersion nozzle 2*b*, which is pushed out to move toward the forward side "F," from being caught on the side face in the rearmost first keyboards 111 on the backward side "B." Consequently, the immersion-nozzle replacement apparatus 1 according to Third Embodiment permits replacing one of the immersion nozzles 2 with the other one of them quickly and steadily without any leakage of molten metal even during founding operations.

OTHERS

The present invention shall not be limited to the embodiments described as above and illustrated in the drawings alone, but can be executed by changing or modifying them suitably within a range not departing from the gist of the present invention.

The invention claimed is:

1. An immersion-nozzle replacement apparatus comprising:

a guiding means supporting at least two immersion nozzles, a foremost immersion nozzle and a rear immersion nozzle following the foremost immersion nozzle, the two immersion nozzles each having an upper flange with a sprue port, and a lower tube, the guiding means including first and second rows disposed parallel to one another on both sides of the tube of each of the immersion nozzles to support a lower face in the flange of each of the immersion nozzles while coming into contact with a side face in the flange of each of the immersion nozzles horizontally; and a first pressing keyboard row provided in the first row of the guiding means and a second pressing keyboard row provided in the second row of the guiding means, each of the first and second pressing keyboard rows including a plurality of first keyboards pressing the lower face in the flange of the foremost immersion nozzle onto a flow-out port in a molten-metal retainer;

the immersion-nozzle replacement apparatus pushing out the foremost immersion nozzle horizontally with the rear immersion nozzle, as well as putting the rear immersion nozzle on each of the pressing keyboard rows;

each of the first and second rows of the guiding means further including an additionally-pressing keyboard row which follows a rear end of each of the first and second pressing keyboard rows and includes a second keyboard pressing the lower face in the flange of the rear immersion nozzle before pushing out the foremost immersion nozzle; and the second keyboard pressing the lower face in the flange of the rear immersion nozzle so as to provide the flange of the rear immersion nozzle at a leading end thereof with a height, which is identical with a height that the flange of the foremost immersion nozzle has, when the rear immersion nozzle is moved to a position at which the rear immersion nozzle neighbors the foremost immersion nozzle horizontally.

2. The immersion-nozzle replacement apparatus as set forth in claim 1, wherein each second keyboard includes an upper face pressing the lower face in the flange of the rear immersion nozzle, part of the upper face making an inclined face which heightens toward a leading-end side thereof.

3. The immersion-nozzle replacement apparatus as set forth in claim 2, wherein each second keyboard includes a leading-end side in part of the upper face pressing the lower face in the flange of the rear immersion nozzle, the leading-end side pressing the lower face in the flange of the foremost immersion nozzle at a rear end thereof.

4. The immersion-nozzle replacement apparatus as set forth in claim 1, wherein each of the first and second pressing keyboard rows includes keyboard pressing members which press the first keyboards downward, and wherein each of the first keyboards includes a rotary shaft around which each of the first keyboards rotate when pushed downward by the keyboard pressing member to push the lower face in the flange upward.

* * * * *